US005657601A

United States Patent [19]

Bean et al.

[11] Patent Number: 5,657,601

[45] Date of Patent: Aug. 19, 1997

[54] FORM TIE ROD SPACER ASSEMBLY FOR STAY-IN-PLACE FORMS

[75] Inventors: Dennis L. Bean; William Newell Brabston; Philip Garcin Malone; Stafford S. Cooper, all of Vicksburg, Miss.; Roger H. Jones, Jr., Reno, Nev.

[73] Assignee: The United States of America as represented by the Secretary of the Army, Washington, D.C.

[21] Appl. No.: 531,511

[22] Filed: Sep. 21, 1995

[51] Int. Cl.[6] ..... E04B 2/86

[52] U.S. Cl. ..... 52/426; 52/442; 249/41; 249/214

[58] Field of Search ..... 52/562, 426, 427, 52/440, 220.4, 424, 783.17, 793.1, 442, 565, 568, 783.19; 249/214, 40, 41, 190, 191, 193, 213

[56] References Cited

U.S. PATENT DOCUMENTS

| | | | |
|---|---|---|---|
| 1,293,391 | 2/1919 | Ewing . | |
| 2,076,473 | 4/1937 | London . | |
| 3,010,175 | 11/1961 | Shoemaker | 249/41 |
| 4,037,379 | 7/1977 | Ozanne | 52/783.17 X |
| 4,239,173 | 12/1980 | Sawyer | 249/41 |
| 4,889,310 | 12/1989 | Boeshart | 249/214 X |
| 4,938,449 | 7/1990 | Boeshart | 249/216 |
| 5,016,411 | 5/1991 | Thorsnes | 52/220.4 |
| 5,255,488 | 10/1993 | Johnson et al. | 249/40 |

*Primary Examiner*—Michael Safavi
*Attorney, Agent, or Firm*—Luther A. Marsh

[57] ABSTRACT

An apparatus for assembling two cement board stay-in-place form panels for making concrete-filled walls that is cost-effective and forms a uniform precise composite wall construction. The assembly includes a coextensive corrugated spacer panel between the form panels for maintaining a uniform distance there between. The forms and spacer panels are secured in place with a notched tie rod that penetrates the spacer and both wall panels, this assembly allows for rapid form installation. The spacer panel has two embodiments, viz. i) a preformed rigid corrugated panel and ii) a flattened unassembled panel with precut fold lines that are folded at the building site and then secured with a dowel-rod bracing component. The apparatus preferably uses fiber-glass-reinforced cement board for the stay-in-place forms. The final composite wall construction typically is made up of 4 feet wide by 8 feet high by 6.5-inch thick composite wall sections. The form walls use standard 4 feet by 8 feet by half-inch thick concrete or cement bard. Assembly of composite wall form requires erecting the corrugated spacer panel first and then attaching two form panels to the spacer panel's corrugations thereby forming a series of vertical compartments that are then filled with concrete or foam concrete with proper reinforcement.

11 Claims, 3 Drawing Sheets

FORM TIE ROD SPACER ASSEMBLY FOR STAY-IN-PLACE FORMS

STATEMENT OF GOVERNMENT INTEREST

The invention described herein may be manufactured and used by or for the United States Government for governmental purposes without the payment of any royalties thereon.

FIELD OF THE INVENTION

The invention pertains to an improved apparatus for assembling two cement-boards stay-in-place forms for making concrete-filled walls.

BACKGROUND OF THE INVENTION

In the conventional apparatus of assembling stay-in-place cement board (also known as concrete board) forms for wall units the cement boards, that are typically in the form of 4 feet by 8 feet by half inch-thick fiber-glass reinforced cement board panels, are lifted into place and held using flexible form ties. Consistent spacing between the cement boards is maintained by using plates or tubes attached to or fitted around the form ties. U.S. Pat. No. 4,598,519 entitled "Composite Concrete Walls Having Tie & Form Spacing" and U.S. patent application Ser. No. 08/066,675 entitled "Building Wall & Method of Constructing Same" are examples of this method. Blocks placed around the top and sides of the concrete panels can also be used as taught in U.S. Pat. No. 4,938,449 entitled "Tie for Concrete Forms." Foamed concrete is then pumped into the space between the boards. After the concrete has gained strength, the ends of the form ties are trimmed flush with the cement board forms. Limitations of these existing apparatus include: i) The form ties must be threaded through holes in one wall panel and then through corresponding holes in the second wall panel. Generally both panels must be braced partly upright to place the form ties. The forms that will be filled with concrete to make wall sections generally have the wall panels 5.5 inches apart to make a 6.5-inch thick wall. The panels have to be braced partly upright and far enough apart for a crew member to move between them. Thus long form ties are needed although when assembled the wall panels will be only 5.5 inches apart. ii) All of the form ties must be in position before any of the form ties are tightened or secured by bracing. There is no easy way to add form ties after the form is assembled; and iii) Until the fasteners on the form ties are tightened down, the form ties do not support the wall panels.

U.S. Pat. No. 2,076,473 entitled "Building Construction" teaches of a corrugated spacer construction in a composite form construction where the spacer assembly has a boss structure that inserts into a corresponding depression in the wall forms. Limitations of this type of spacer-tie assembly are: i) The complexity of the wall forms and the spacer construction; ii) The load from the fluid concrete is transferred to the spacer which can be deformed by the outward pressure exerted by the concrete mixture prior to setting; iii) The connection of the spacer to the wall panel is by means of a concave disk that must be flattened in a pre-drilled hole that partly penetrates the wall panel, thus producing a relatively weak attachment to the panel; and iv) The holes in the wall panels are drilled to half-depth and must be precisely aligned with respect to the spacer if the wall panel is to be properly attached to the spacer.

These prior form-tie rod assemblies generally require excessive time to construct and require complexindividuated component members that entail excessive expense. These problems are solved by the form-tie rod assembly of the instant invention.

SUMMARY OF THE INVENTION

The invention pertains to an apparatus for assembling two cement board stay-in-place form panels for making concrete-filled walls that is cost-effective and forms a uniform precise composite wall construction. The assembly includes a coextensive corrugated spacer panel between the form panels for maintaining a uniform distance there between. The forms and spacer panels are secured in place with a notched tie rod that penetrates the spacer and both wall panels, this assembly allows for rapid form installation. The spacer panel has two embodiments, viz. i) a preformed rigid corrugated panel and ii) a flattened unassembled panel with precut fold lines that are folded at the building site and then secured with a dowel-rod bracing component. The apparatus preferably uses fiber-glass-reinforced cement board for the stay-in-place forms. The final composite wall construction typically is made up of 4 feet wide by 8 feet high by 6.5-inch thick composite wall sections. The form walls use standard 4 feet by 8 feet by half-inch thick concrete or cement board. Assembly of composite wall form requires erecting the corrugated spacer panel first and then attaching two form panels to the spacer panel's corrugations thereby forming a series of vertical compartments that are then filled with concrete or foam concrete with proper reinforcement.

DETAILED DESCRIPTION OF THE INVENTION

Figure 1:
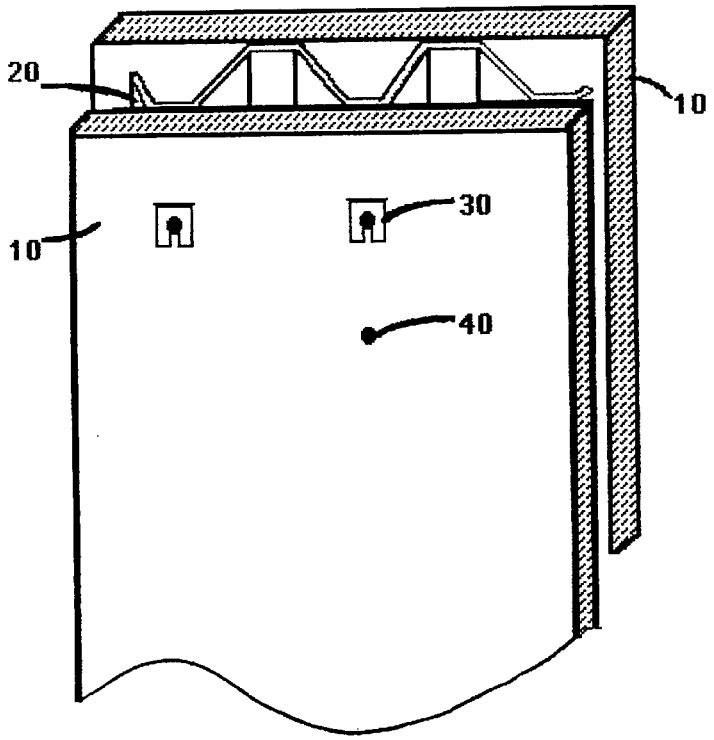
FIG. 1 shows the invention in assembled form with the two form panels and the corrugated spacer panel therebetween.

FIG. 1 shows the invention in assembled form with the two form panels 10 with the corrugated spacer panel 20 there between. The corrugated spacer panel 20 has an overall thickness from the top of one corrugation to the top of the opposite corrugation that is identical to the width of the interior space of the wall form which is generally 5.5 inches wide in a typical building wall construction. The wall panels 10 fit flush against the ribs of the corrugated spacer panel 20 and produce a series of vertical compartments that are filled with concrete or foamed concrete 25 to produce the composite wall. The invention's assembly will prevent the wall panel 10 from bowing inward at their centers. The corrugated spacer 20 facilitates support of the wall panels at closely spaced intervals along the entire width of each wall panel 10 and not just at the edges and top which is the conventional practice. The tie rods 40 are notched to provide a specific spacing for the wall panels with spacer. The retaining clip 30 is disposed in a designed groove, thus it is impossible to overtighten the ties 40 that frequently occurs in conventional assemblies. This feature is taught in U.S. Pat. No. 1,293,391 entitled "Tie & Spacing Member for Concrete Construction." In contrast, the instant invention include: i) tie rods that are made of a more readily shareable material that facilitates removal of their ends by a single blow to the cliff 30 and ii) the tie rods 40 are designed to support the form panels as soon as they are positioned and do not require the addition of clips for holding additional components of locking disks, washers or locking wedges as taught in U.S. Pat. No. 1,293,391. Notches are formed on only one side of the tie rod 40 so that the rod drops down and the notches engage the cement board panels 10 at bottom edges of the holes drilled through the wall panels and the spacer panel. Notching only one side of the tie rod allows a deep notch to be formed yet still preserves a useful cross-section of the tie rod that is of sufficient strength to take the strain produced by loading of the form panels 10 by fresh poured concrete. Also, the form walls 10 will not bulge when the ties are too loose.

A series of notched tie rods 40 are used instead of conventional flexible form ties to hold the three panels 10 & 20 together in a sandwich-like unit. In a typical operation; the spacer panel 20 is lifted upright with the corrugations in a vertical direction. One wall panel 10 is lifted into position against the spacer panel 20 on either side of the corrugated spacer 20, then the other. the three panels are then braced in a vertical position and clamped together. Holes are then drilled from one side preferably at points where the ribs of the spacer 20 corrugations contact one of the wall panels 10. Properly sized rigid tie rods 40 that fit snugly in the drilled holes are then inserted into the holes. The rods drop down over the lower edge of the hole and engage the cement board panels 10 and the cement board spacer 20. The panels and spacer 10 & 20 are held together without inserting any clips or locknuts. The corrugated spacer 20 and the wall panels 10 thus form a series of hollow vertical compartments. A single compartment or group of compartments can i) remain void for pipe or wiring runs or ii) be filled with either foam concrete or concrete with reinforcing steel if a structural column is required for increased bearing wall capacity. Moreover, the vertical joints in the wall panels 10 and the spacer panel 20 can be staggered such that no weak points are present in a composite wall structure since the vertical joints are not spaced opposite each other.

Figure 2:
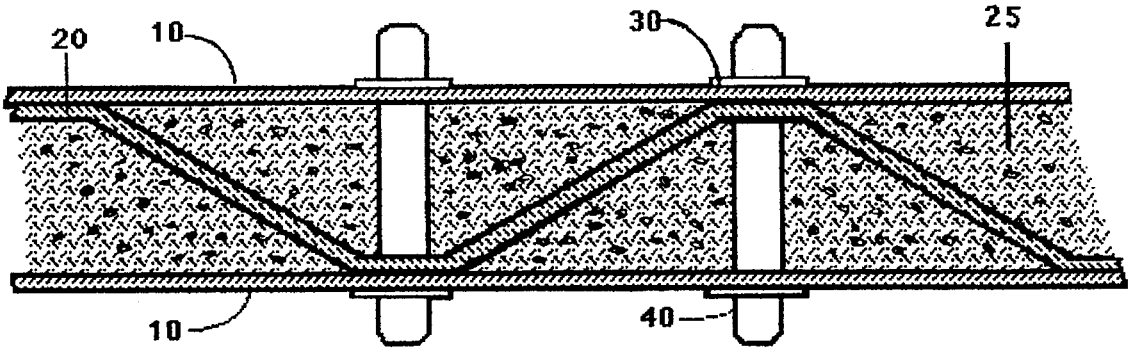
FIG. 2 shows a top view of the form wall and spacer assembly.
Figure 3:
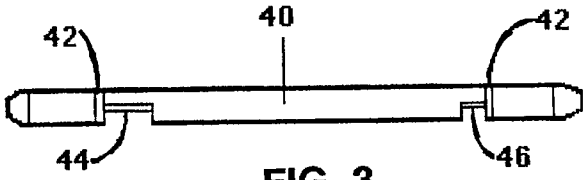
FIG. 3 shows the tie rod used in the invention.
Figure 4:
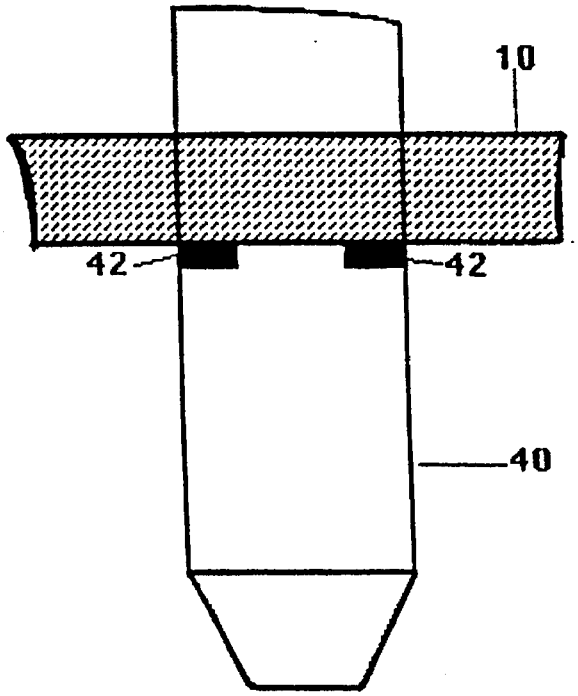
FIG. 4 shows the interface of the tie rod with a form wall and the retaining clip used for stabilizing the assembly.
Figure 5:
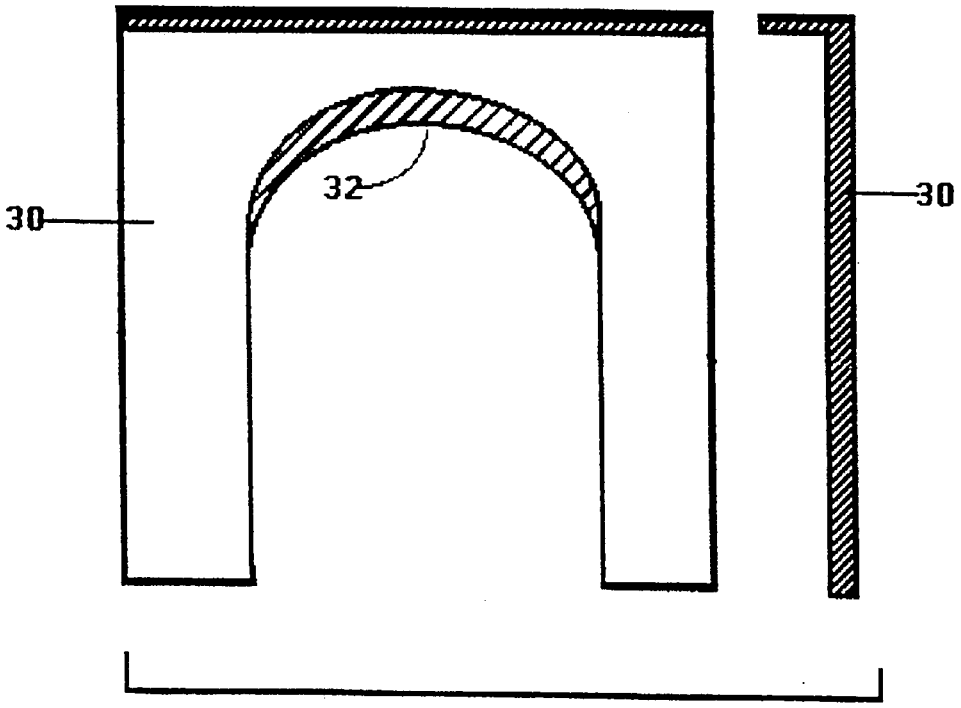
FIG. 5 shows the retaining clip for stabilizing the assembly.

FIG. 2 shows a top view of the tie-form assembly and FIG. 3 shows tie rod 40 with notches that fit over the cement board panels 10 at the lower edge of each hole. The notches 44 & 46 engage the wall panels 10 and hold the sandwich-like unit together with notch 44 being larger to accommodate the thickness of both wall & spacer panels. The notched rod 40 is centered in holes in the wall panels 10 as they are being inserted. Frustum-shaped ends of each tie rod 40 assist in locating and inserting tie rod 40 into the three holes in the panels. When the notches 44 & 46 engage the two cement board wall panels 10 and spacer panel 20, the tie rod 40 drops down producing a crescent-shaped opening above the tie rod 40. Metal retaining clip 30 extends upward and covers this opening. The metal retaining clip 30 is pushed down into a precut groove 42 in the tie rod as shown in FIG. 4. The retaining clip 30 fits closely against the exterior of the wall panels 10 and covers the hole and prevents poured fresh concrete from leaking out of the form walls 10. The tie rod 40 is inserted through holes in the two wall panels 10 and the spacer panel 20 while working on one side of a composite wall form. Initially, the wall panels and spacer 10 & 20 are held in place by the notches 44 & 46 and there is no need for immediate attachment of retaining clip 30 to keep the form walls 10 in position. However, the retaining clip 30 provides additional support and cover openings left at the top of the tie rod hole before the concrete fills the tie-form assembly otherwise, the poured concrete in the wall form would leak out through these holes. By rotating the U-shaped retaining clip 30 so that the open end is at the top, a sealer can be injected into a crescent-shaped opening above the tie rod that exist after the insertion and positioning of the tie rod 40. The retaining clip as shown in FIG. 5 has a beveled inner edge 32 that is sharp such that a blow to the top of the clip shears off the end of the tie rod resulting in a flush composite external surface wall. This retaining clip design facilitates in cutting off the tie rod ends and makes it unnecessary to have a special cutting tool. To accomplish this, the tie rod 40 are preferably molded from either nylon, a durable synthetic polymer or fiberglass. The tie rods can be shaped in either a circular as shown or comparable rectangular cross-section depending on desired shape.

The form walls 10 can be made of any material that forms a strong bond with the concrete that is used for filling the compartment voids in the composite form wall. The preferred materials are steel or fiber-glass reinforced cement board. The tie rods 40 can be made of other materials that are compatible with the poured concrete material as well. The concrete filler can be conventional concrete, foamed concrete, reinforced concrete with structural steel or foamed concrete with fiber reinforcement with structural steel or foamed concrete with fiber reinforcement. Although the figures show only one spacer panel 20 between two wall panels, if a thicker wall is desired, variations to the above described design can include two or more spacer panels placed inbetween the form panels for a built-up required wall thickness.

Figure 6:
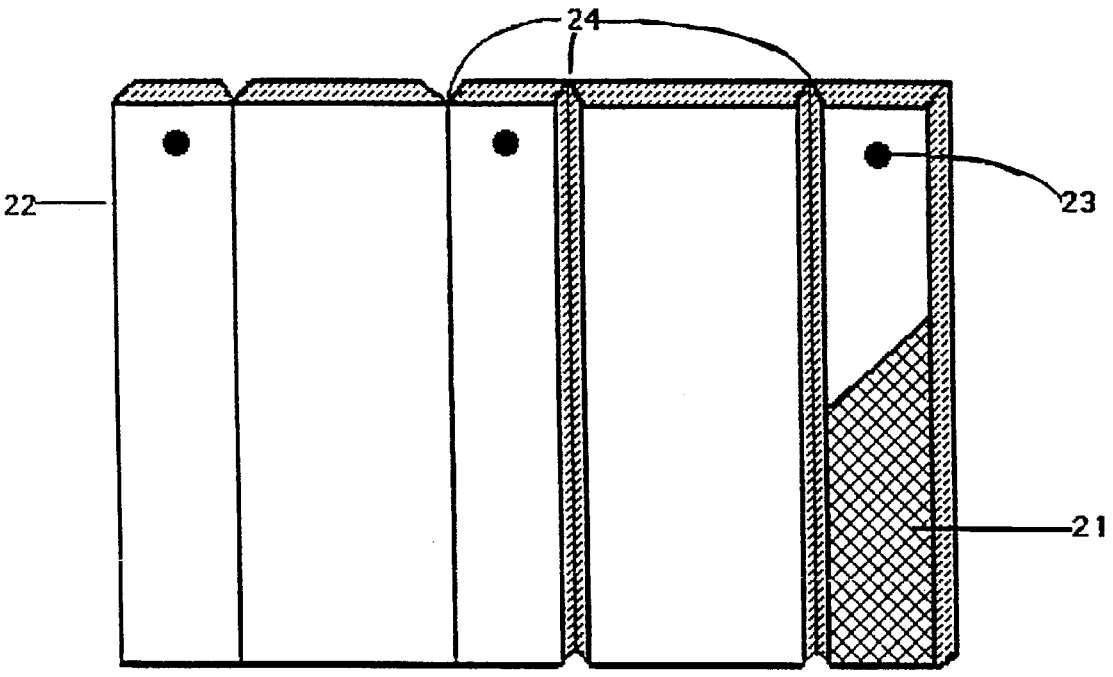
FIG. 6 shows the second embodiment of the spacer panel assembly in flattened form prior to wall assembly.
Figure 7:
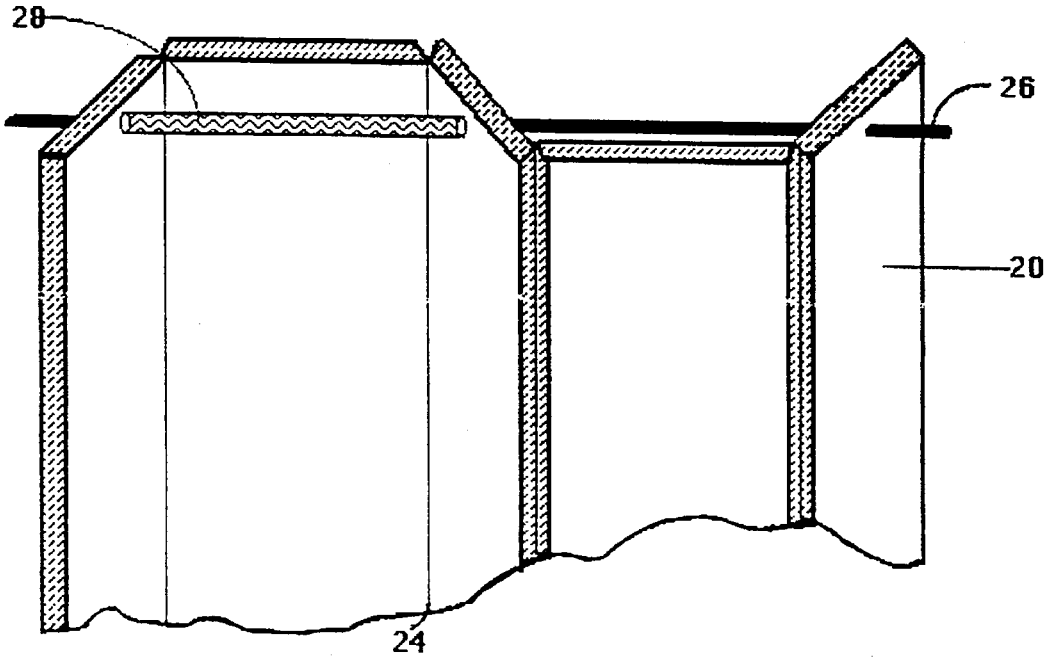
FIG. 7 shows the second embodiment of the spacer panel after being folded and braced with a dowel and bracing rod components.

Another embodiment of the invention is shown in FIGS. 6 & 7 of the design and assembly of the corrugated spacer panel 20. This design facilitates transport and minimizes damage of these panels which are formed at the construction site. This corrugated spacer panel 20 is formed by folding and bracing a flat cement board panel 22 that has been cut or notched and equipped with flexible fabric hinges 24. The panel 22 arrives at the site as a flat sheet which is folded along precut lines to form the corrugated spacer panel 20. The assembled folded panel 20 is held in position by dowels 26 disposed through pre-drilled holes 23 in panel 22 which are aligned when the panel 22 is properly folded. Bracing tubes 28 are slipped over the dowels 26 to assure that the segments of the corrugated spacer panel 20 are held in proper position. The panel 22 can be made from conventional fiber-glass mesh reinforced cement boards by scoring or notching the panels similar to gypsum board wall material. Thus, the fiber-glass mesh 21 that is embedded in the hardened cement board acts as a durable fabric hinge at these fold lines of panel 22. If additional strength is needed, a piece of fabric may be glued or bonded to the cement board panel at the fold line. The dowel 26 and bracing tube 28 arrangement additionally provides reinforcement for the composite wall construction.

While this invention has been described in terms of a specific preferred embodiment, it is understood that it is capable of further modification and adaptation of the invention following in general the principle of the invention and including such departures from the present disclosure as come within the known or customary practice in the building arts to which the invention pertains and may be applied to the central features set forth, and fall within the scope of the invention and of the limits of the appended claims.

We claim:

1. A composite concrete-filled wall comprised of a concrete filler, a pair of exterior facing panels, at least one corrugated spacer panel between the pair of exterior facing panels and multiple tie rods with notches at their extrema for holding together and stabilizing the pair of exterior facing panels at a uniform distance apart in relation to the at least one spacer panel prior to pouring of the concrete filler, wherein the spacer panel is continuous and coextensive with the facing panels and the multiple tie rods are made of a clip shearable material, whereby the corrugated spacer panel and the pair of exterior facing panels form a series of hollow compartments into which the concrete filler is poured resulting in a uniform-dimensioned, non-bulging composite wall.

2. The composite wall of claim 1 wherein some of the compartments are void for facilitating installation of pipe or wiring runs.

3. The composite wall of claim 1 wherein the corrugated spacer panel is a preformed panel.

4. The composite wall of claim 1 wherein the corrugated spacer panel is produced on location by folding and bracing a flat cement bard panel with precut flexible fabric hinges, the resulting corrugated panel is statically maintained by:

i) dowels disposed through pre-drilled holes in the flat panel after being folded and ii) further braced with tubes that are slipped over the dowels.

5. The composite wall of claim 1 wherein the corrugated spacer panel and the exterior facing panels are made of fiber-glass mesh reinforced cement boards.

6. The composite wall of claim 1 wherein the exterior facing panels are made of steel boards.

7. The composite wall of claim 1 wherein each tie rod includes retaining clips disposed in precut grooves in each tie rod for keeping the pair of facing exterior panels in position and covering openings between a tie rod and hole in the facing exterior panels prior to introduction of the concrete filler.

8. The composite wall of claim 7 wherein the retaining clips have a beveled inner edge that is sharp whereby after hardening of the concrete filler, a blow to top of the retaining clip shears off the end of the tie rod resulting in a flush composite external surface wall.

9. The composite wall of claim 7 wherein the tie rods are made of a durable synthetic polymer such as nylon or the like.

10. The composite wall of claim 7 wherein the tie rods are made of fiberglass.

11. The composite wall of claim 1 wherein the concrete filler is selected from the group consisting of concrete, foamed concrete, reinforced concrete and foamed concrete with fiber reinforcement.

* * * * *